United States Patent [19]

Quigg et al.

[11] 4,439,055

[45] Mar. 27, 1984

[54] ANCHOR CONNECTOR

[75] Inventors: Daniel F. Quigg; Darrell L. Jones, both of Ventura; Richard G. McFerron, Camarillo; James L. Bell, Jr., Oak View, all of Calif.

[73] Assignee: Vetco Offshore, Inc., Ventura, Calif.

[21] Appl. No.: 342,452

[22] Filed: Jan. 25, 1982

[51] Int. Cl.[3] ..... B25G 3/18; F16B 21/00; F16D 1/00

[52] U.S. Cl. ..... 403/330; 166/217; 405/202; 403/132; 403/328; 403/14; 403/406; 294/86.25

[58] Field of Search ..... 403/330, 328, 322, 11, 403/14, 132, 406; 405/202, 224; 285/223, 263, 49; 166/217; 297/86.25, 97; 292/256.65

[56] References Cited

U.S. PATENT DOCUMENTS

| | | | |
|---|---|---|---|
| 3,064,737 | 11/1962 | Quinn | 166/217 X |
| 3,445,133 | 5/1969 | Reischl | 294/97 X |
| 4,227,825 | 10/1980 | Oesterle | 403/322 |
| 4,320,993 | 3/1982 | Hunter | 405/202 X |
| 4,347,012 | 8/1982 | Glidden | 405/224 X |
| 4,400,112 | 8/1983 | Castel et al. | 405/224 |

OTHER PUBLICATIONS

Oil & Gas Journal of 7/27/81, pp. 364, 365.

*Primary Examiner*—Wayne L. Shedd
*Attorney, Agent, or Firm*—Edward L. Kochey, Jr.

[57] ABSTRACT

An anchor connector incorporating a flexible joint (16) for securing the tension legs (14) of a tensioned leg platform. A latch dog head (34) engages a first recess (26) on the fixed member (22) of the flexible joint and a template recess (30) to prevent disconnection when the dog heads (34) and latch carrier (40) are in a lower position. With the latch carrier (40) in an upper position the latch dog heads (34) fit within a second recess (44) in the fixed member with the dog heads claring shoulder (32) of template recess (30), whereby the connector may be released.

12 Claims, 4 Drawing Figures

ANCHOR CONNECTOR

BACKGROUND OF THE INVENTION

This invention relates to anchor pile connectors and in particular to releasable connectors for securing the tension legs of a tensioned leg platform. After an offshore well is drilled from a floating platform, it may be desirable to produce the well to a later-installed tensioned leg platform. These platforms, while supported by the buoyancy of the water, are not freely floating but are tied back to a plurality of anchors and tensioned from the seabed. Typically, a plurality of tension lines are located at each corner of the platform and all are maintained continuously in tension although the amount of tension may vary and the lines may vary up to 15 degrees from the vertical at the anchor location.

An anchor template is secured to the seabed with driven and/or drilled and cemented piles. The tension legs are run from the various anchor templates to the platform. Each is typically a 23 cm OD by 8 cm ID tubular member in threaded sections, operating under a nominal tension of 1,000 tons. For the purpose of inspecting these lines at a later date, it is desirable to retrieve the entire string of a particular leg while the remaining legs continue to carry the load.

In using a connector with a flexible joint therein all of the bending movement is taken by the flexible elements of the joint and the majority of the bending force is absorbed by the movement of the flexible portions. Tension placed on the connection occurs by a force passing through the pivot center of the joint with the force passed upwardly to the latch body by compression through the flexible bearing. This then passes the force through the upper portion of the fixed body of the flexible connector. When the connection between the fixed body and the template is in the lower portion of the body, the forces must pass through the body with resultant bending moments placed on the body and on the latch connection. By placing the latch connection above the center of pivoting of the flexible connector these forces may be passed directly into the template thereby reducing the forces placed on the fixed member of the flexible joint.

Still with this arrangement it is desirable to have a connector while will lock without the need for external operation and which will remained locked even though tension on the leg will be momentarily relaxed. It is also desirable that the connector be capable of being unlatched for retrieval of the leg as desired.

SUMMARY OF THE INVENTION

An anchor connector for connecting a tension leg of a tension leg platform to a subsea template includes a flexible joint which is universally pivotable. The fixed member of this flexible joint has a first circumferential recess at an elevation above the pivot center of the joint, this recess having an upwardly facing shoulder at the lower edge thereof. The fixed member also has a second circumferential recess on the outside diameter deeper than the first recess but immediately above and contiguous therewith.

A cylindrical template receptacle has an annular circumferential template recess in the interior surface with a downwardly facing shoulder at the upper end of the recess which is slightly above the upwardly facing shoulder when the connector is in its locked position. A latch carrier is moveable between an upper and lower position and is pivotally mounted thereon a plurality of latch dogs with latch dog heads at their upper end adapted to mate with the downwardly and upwardly facing shoulders described above.

With the latch carrier in its downward position the latch dog heads are sized and maintained so that they interact and abut with the upwardly facing shoulder and downwardly facing shoulder on attempted upward movement of the flexible connector whereby the connector is maintained in latched condition with the template receptacle.

The dogs and the second recess in the fixed member are sized such that with the latch carrier in the upward position the dog heads fit within the second recess sufficiently to clear the upper shoulder of the template receptacle whereby the connector may be withdrawn when the latch dogs are in this position.

Means for camming the dogs outwardly on downward movement of the latch carrier are provided by the interaction between the upwardly facing shoulder in the first recess and the bottom edge of the dog heads, assisted by gravity with the center of gravity of the dogs being outboard of the pivot point.

Means for camming the dogs inwardly on upward movement of the latch carrier with respect to the fixed member are provided by a cap at the upper end of the second recess which interacts with the upper surface of the latch dog heads on upward movement. Also, the angle of the downwardly facing shoulder in the template receptacle is arranged such that upward movement of the latch dogs with respect to the template will cause them to be urged inwardly, but they may move inwardly only if the latch carrier is in the upper elevation.

An apparatus is also provided to maintain the latch carrier in the upper elevation while running the connector. With this apparatus in use, the cap above the second recess operates to retain the dogs in an inboard position and also protects the dogs from damage on accidental bumping. A restraint is provided for preventing outward movement of the dogs any significant amount beyond the desired latching position in the event that the connector is run without the running tool in place. This operates to maintain the dogs in an upwardly extending position so that they may be moved inwardly by interaction with the template receptacle during insertion of the connector.

The fixed member of the flexible connector has a lower circumferential bearing surface for interaction with the template. At the upper bearing surface adjacent to the first annular recess the connector is in the form of a solid ring. Between these two locations, where the forces transmitted through the fixed member are relatively small, the member is slotted to permit the arms of the dogs to pass therethrough so that each dog head is maintaned outboard of the fixed member while the pivot connection between each dog and the latch carrier is inboard of the lower bearing surface.

DESCRIPTION OF THE PREFERRED EMBODIMENT

Figure 1:
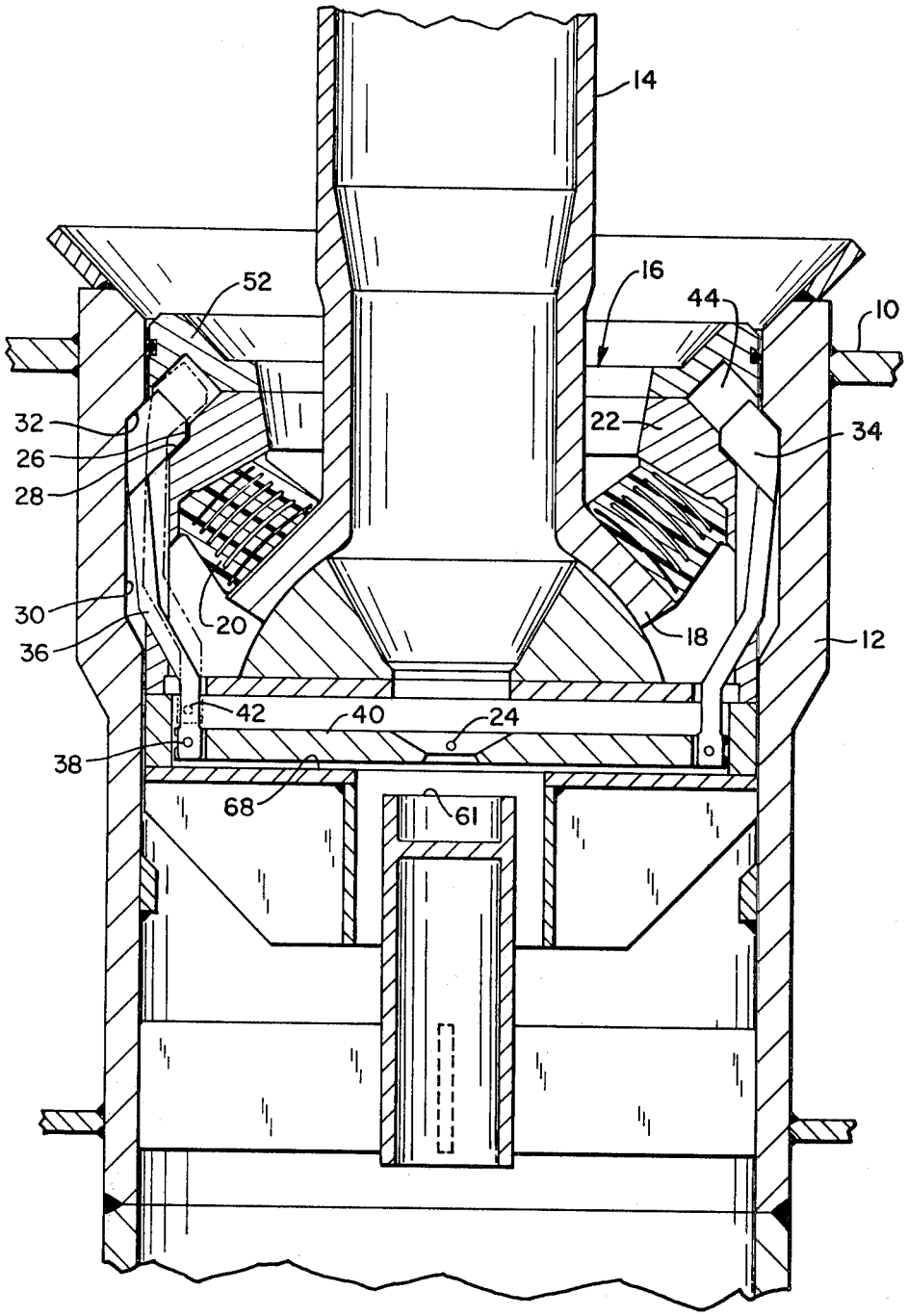
FIG. 1 is a general arrangement showing the connector in its latched position.

A tensioned leg platform (not shown) is anchored to the sea floor using a series of tubular tension legs which are preloaded using platform buoyancy. These legs are to be mechanically latched to receptacles in templates which are anchored to the sea floor. FIG. 1 shows such a template 10 with a template receptacle 12 to which the tension leg 14 is to be latched.

A flexible joint 16 is comprised of a pivotal member 18 and elastomeric bearing 20 and a fixed member 22. The tension placed on the pivotable member may be as much as 15° from the vertical with the elastomeric bearing 20 permitting the pivotable member 18 to pivot around the pivot center 24. The bearing 20 permits the movement with the minimum transmittal of bending forces to the fixed member 22. Compression forces resulting from tension in tension leg 14, however, are passed directly through the elastomeric bearing into the fixed member at an upper elevation.

At this upper elevation the fixed member 22 has a first circumferential recess 26 with an upwardly facing shoulder 28. The template at a similar elevation has a circumferential template recess 30 on its inner diameter with a downwardly facing shoulder 32 at its upper end. A latch dog head 34 is sized together with the recesses so that it simultaneously interacts with downwardly facing shoulder 32 and upwardly facing shoulder 28 in the illustrated position to prevent movement of the flexible connector upwardly with respect to the template receptacle.

A plurality of latch dogs 36 are pivotally connected at pivot point 38 to a latch carrier 40. This latch carrier is vertically moveable with respect to the fixed member 22 from the position illustrated by the solid line to that suggested by the phantom lines of the latch dog and alternate pivot point 42.

A second recess 44 is located on the outside diameter of the fixed member immediately above the first recess but deeper than the first recess and contiguous therewith. As illustrated in phantom with the latch carrier in the upper position the second recess is sized such as to accept the latch dogs therein sufficiently for the latch dog head to clear the downwardly facing shoulder 32 of the template receptacle. With the latch dogs in this location the connector may be withdrawn from the template receptacle.

Figure 2:
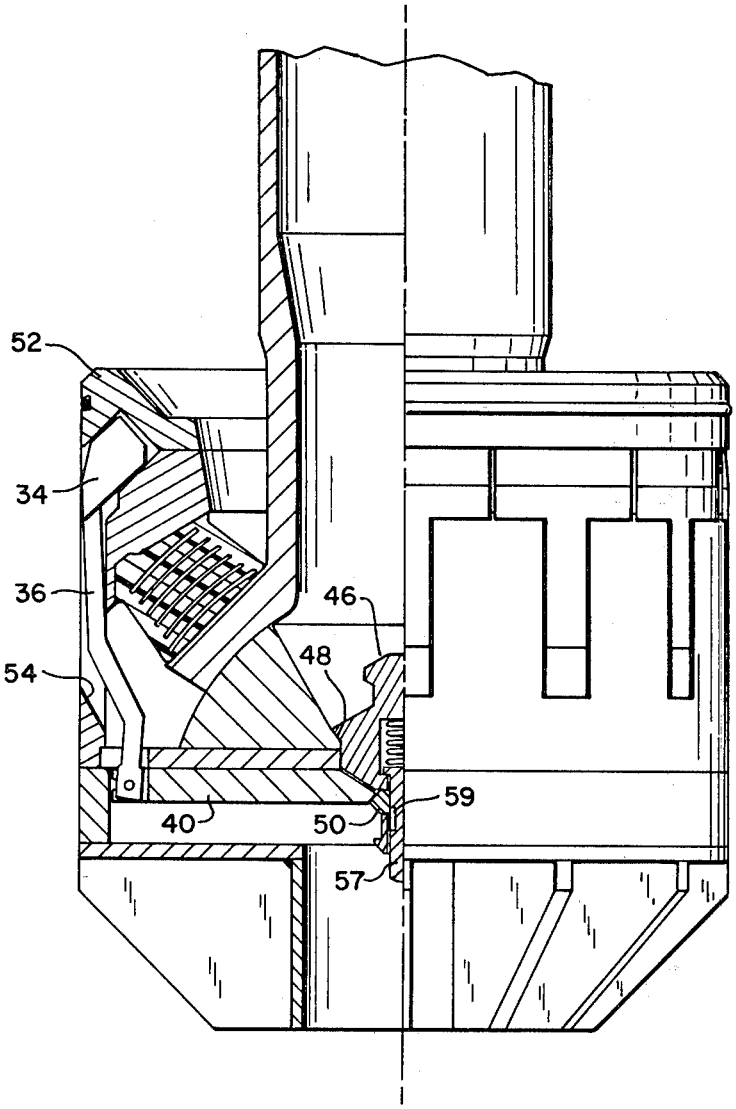
FIG. 2 shows the connector in the running condition with a running tool inserted.

As illustrated in FIG. 2 a running tool 46 engages an upper surface 48 on the fixed member of the flexible connector and has dog segments 50 which fit under the latch carrier 40 and maintain it in the upper position. In this position the latch dog head 34 is constrained by cap 52 and thereby held in the inboard position to permit entry of the connector into the template receptacle. The cap also operates to protect the latch dogs 36 from damage on impact with extraneous elements.

If the connector were being run without the running tool 46 the latch carrier 40 would fall to its lower position and the dogs 36 would swing outwardly. The maximum movement of these dogs is restrained by surface 54 on the fixed member which operates against the dog to limit its outward movement. With such an operation the upper edge of the template receptacle would engage the dogs swinging them in toward the illustrated position. The angle of the dog legs which will be interacting with the template must be arranged such that the tendency is to raise the dogs and the carrier to the unlatched position illustrated in FIG. 2 in order to permit entry into the receptacle.

Figure 3:
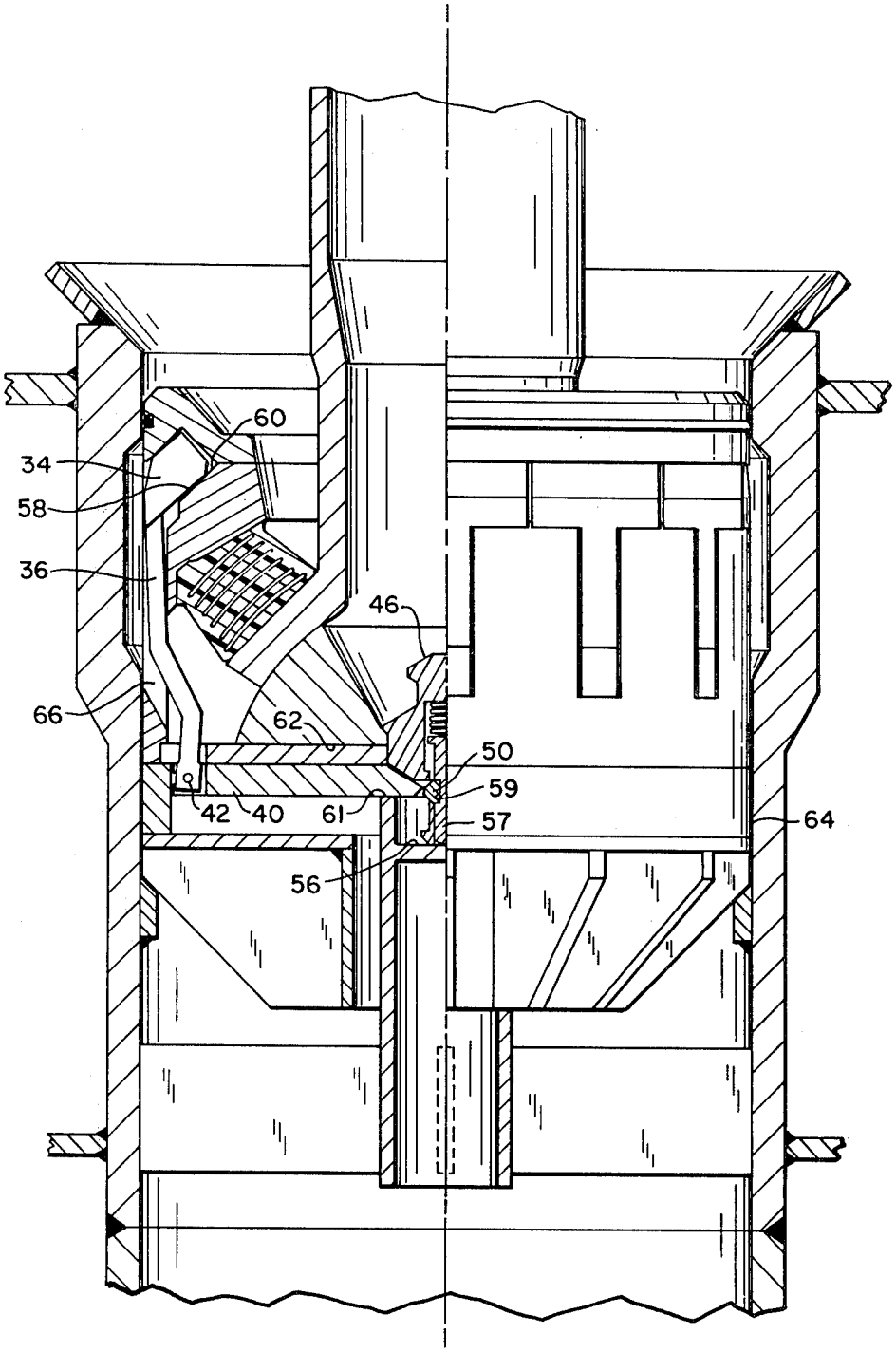
FIG. 3 shows the connector being landed just prior to full insertion.

FIG. 3 illustrates the connector just immediately prior to landing with the dogs still in the retracted position. Upon downward movement of the connector beyond that illustrated, stop 56 operates against a plunger 57 in the lower portion of the running tool 46 and prevents further movement of the plunger. Further movement of the connector permits the dog segments 50 to move within slot 59 of the plunger. The latch carrier 40 may then move over the dog segments 50 so that it may freely fall into the lower position.

As the latch carrier falls to its lower position the latch dog head 34 is cammed outwardly by the interaction between its lower surface 58 and the upwardly facing shoulder 60 of the second recess. This operates to cam the dogs outwardly and the movement is aided by the center of gravity of the latch dogs 36 being outboard of the pivot point 42. On subsequent upward movement of the connector the latch dogs and carrier remain at the lower elevation because of gravity and the dog head latches in to the locked position as illustrated in FIG. 1.

Should tension be inadvertently lost on the tension leg the latch dogs will reengage since gravity will maintain the latch carrier and dogs in their lower position such that they ride up and down within the first recess 26. Should additional security be desired a removeable blocking element may be placed between the latch carrier 40 and the lower surface 62 of the flexible connector body. The running tool 46 may of course be removed at this time since its only function is to maintain the latch carrier 40 in its upward position while running the connector.

It can be seen that the maximum forces pass through the flexible connector directly to the upper portion of the fixed member and thereon through the dog heads to the template receptacle. Accordingly, the upper portion of the fixed element adjacent the first recess 26 is solid member. At the lower end of the fixed member is a bearing surface 64 which may or may not be a solid surface. Between these two elevations however, there is located in the fixed element slots 66 through which the dogs pass so that the pivot point 42 may be inboard of the lower bearing surface 64 with the dog heads 34 being outboard of the fixed member. Slotting in this area of the connector is not detrimental since the major forces are being passed through the solid ring adjacent the first recess.

It can be further seen that even after the connection is made an upward movement of the latch carrier will cause the upper surface of dog heads 34 to interact with the cap surface to cam the dogs inwardly. As a supplement or alternate the upper surface of the dog head 34 can be arranged to interact with the downwardly facing shoulder 32 of the template receptacle to force the dogs inwardly on upward movement of the connector. It is noted that this can only be accomplished however, if the dog heads and the latch carrier are in their upper position so that the dog heads may move into the second annular recess of the fixed member.

A latch carrier stop 68 is located slightly below the lower position of the latch carrier. This limits the movement of the latch carrier so that in the running condition the dogs will not through their interaction with the restraint surface 54 prematurely jam against the first recess shoulder 28.

Figure 4:
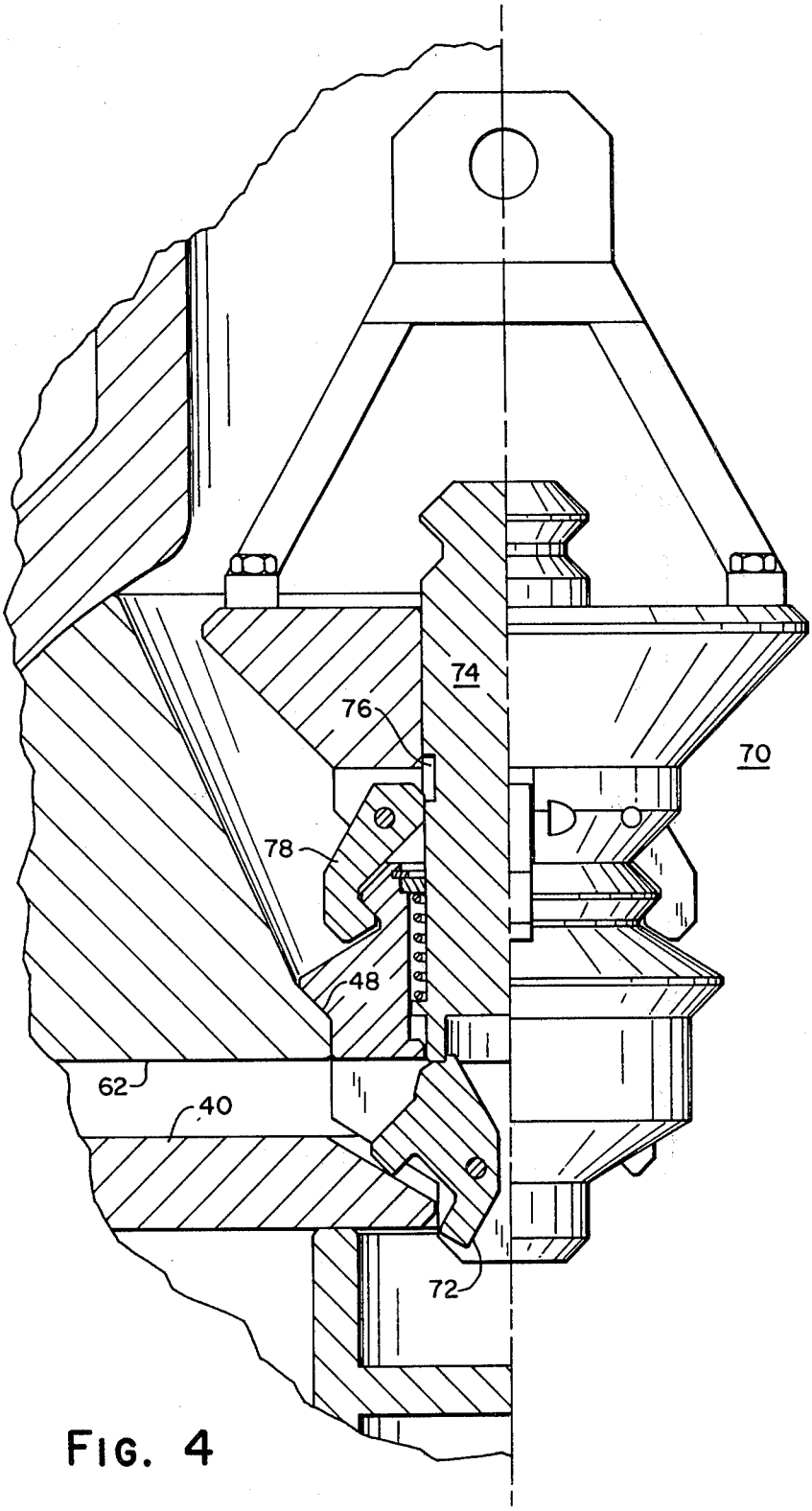
FIG. 4 illustrates a primary release tool which may be used for unlatching the connector.

FIG. 4 illustrates a means of disconnecting the connector with the use of a primary release tool 70. The tool is lowered until it rests on surface 48. Thereafter the strain on the tension leg is released, and the downward movement of the latch carrier 40 is blocked by stop 61. Lower surface 62 continues down toward the latch carrier 40. Additional movement beyond that illustrated in FIG. 4 causes the cam 72 to rotate around its pivot point with spring operated plunger 74 locking the cam into its rotated position and simultaneously moving slot 76 to a position which releases clamps 78. The upper portion of the release tool may then be retrieved with the lower portion remaining in place to lock the latch carrier in the upper position. With the carrier in this upward position the dog heads 34 are retained in the second annular recess so that the connector may be withdrawn from the template receptacle.

We claim:

1. An anchor connector for connecting a tension leg of a tensioned leg platform to a subsea template comprising: A flexible joint having a universally pivotable member for connection to the tension leg, and a fixed member; said fixed member having a first circumferential recess on its outer diameter at an elevation above the pivot center of said flexible joint with an upwardly facing shoulder at its lower end, and a second circumferential recess on its outer diameter, above, contiguous with, and deeper than said first recess; a cylindrical template receptacle having an annular circumferential template recess on its inner diameter with a downwardly facing shoulder at its upper end; a latch carrier free to move between an upper position and an lower position with respect to said flexible joint; a plurality of latch dogs pivotally connected to said latch carrier, and having a dog head at the upper end of each; said dogs, template recess, and first recess being sized such that in the lower latch carrier position said dog head must engage both the upwardly facing shoulder of said first recess and the downwardly facing shoulder of said template recess on upward movement of said flexible joint; and said dogs and said second recess being sized such that in the upper latch carrier position said dog head fits within said second recess sufficiently for said dogs to clear said downwardly facing shoulder of said template recess on upward movement of said flexible joint.

2. An apparatus as in claim 1: having also means for camming said dogs outwardly on downward movement of said latch carrier with respect to said fixed member.

3. An apparatus as in claim 2 wherein said means for camming said dogs outwardly comprises a downwardly and outwardly extending surface at the lower end of said second recess.

4. An apparatus as in claim 1: wherein said latch dogs have the center of gravity thereof outboard of the pivotal connection of said latch carrier and said dogs.

5. An apparatus as in claim 1: having also means for camming said latch dogs inwardly on upward movement of said latch dogs with respect to said flexible joint.

6. An apparatus as in claim 5 wherein said means for camming inwardly comprises a cap at the upper edge of said second recess having a downwardly facing surface extending upwardly toward the inboard portion of said connector.

7. An apparatus as in claim 1: having means for restraining outward movement of said latch dogs from outward movement at a location just beyond that required to engage said first recess.

8. An apparatus as in claim 7: said fixed member having a stop with relation to said latch carrier at a position slightly below said lower position, said stop being located such that said latch dog heads are not fully disengaged from said first recess when said latch carrier bottoms against said stop.

9. An apparatus as in claim 3: wherein said latch dogs have the center of gravity thereof outboard of the pivotal connection of said latch carrier and said dogs.

10. An apparatus as in claim 9: having a cap at the upper edge of said second recess having a downwardly facing surface extending upwardly toward the inboard portion of said connector, for camming said latch dogs inwardly on upward movement of said latch dogs with respect to said flexible joint.

11. An apparatus as in claim 1: having means for restraining outward movement of said latch dogs from outward movement at a location just beyond that required to engage said first recess; said fixed member having a stop with relation to said latch carrier at a position slightly below said lower position, said stop being located such that said latch dog heads are not fully disengaged from said first recess when said latch carrier bottoms against said stop.

12. An apparatus as in any one of claims 1–11: wherein said fixed member has a circumferential outside bearing surface at a lower elevation for interaction with said template receptacle, said latch dogs being pivotally connected to said latch carrier inboard of said bearing surface, said fixed member having a solid ring adjacent said first recess and being slotted for passage of said latch dogs at an elevation between said first recess and said bearing surface.

* * * * *